United States Patent [19]

Matsumura et al.

[11] Patent Number: 4,873,466

[45] Date of Patent: Oct. 10, 1989

[54] IGNITER PLUG

[75] Inventors: Shuzo Matsumura; Takanori Mizuno; Noboru Aoki; Takahire Suzuki, all of Nagoya, Japan

[73] Assignee: NGK Spark Plug Co., Ltd., Nagoya, Japan

[21] Appl. No.: 93,975

[22] Filed: Sep. 8, 1987

[30] Foreign Application Priority Data

Sep. 6, 1986 [JP] Japan ..... 61-208874

[51] Int. Cl.[4] ..... H01T 13/20

[52] U.S. Cl. ..... 313/131 R; 313/139

[58] Field of Search ..... 313/131 R, 139, 131 A, 313/11.5

[56] References Cited

U.S. PATENT DOCUMENTS

| | | | |
|---|---|---|---|
| 2,831,138 | 4/1958 | Teasel | 313/131 R X |
| 2,939,983 | 6/1960 | Pierce et al. | 313/131 R |
| 3,691,419 | 9/1972 | Van Uum et al. | 313/139 X |
| 4,540,910 | 9/1985 | Kondo et al. | 313/11.5 |

FOREIGN PATENT DOCUMENTS

| | | | |
|---|---|---|---|
| 712363 | 7/1954 | United Kingdom | 313/131 |

*Primary Examiner*—Palmer C. DeMeo

*Attorney, Agent, or Firm*—Cooper & Dunham

[57] ABSTRACT

An igniter plug comprising: a metallic shell having a diameter-reduced seat at one open end, the seat being tapered to progressively decrease its diameter as approaching at outside of the open end; a tubular insulator concentrically placed at an inner side of the metallic shell, and having a tapered end face to be in registration with the seat; a frusto-cone shaped insert ring made of oxidation and heat resistant material, a peripheral end and one entire surface of which are mounted on a surface of the seat by means of an electrical resistant welding, the insert ring permitting the tapered end face of the insulator to engage with an upper surface of the insert ring; a center electrode concentrically disposed in the insulator, one end of the electrode being terminated short of the tapered end face to allow a creeping discharge to occur along an inner surface of the insulator when a high voltage is applied across the electrode and the insert ring.

2 Claims, 2 Drawing Sheets

IGNITER PLUG

BACKGROUND OF THE INVENTION

1. Field of the Invention

The present invention relates to an improved igniter plug particularly useful to be employed for use in aircraft jet engines and gas turbine engines and burners.

2. Description of Prior Art

An igniter plug employed in a gas turbine engine of an aircraft is usually of the type of surface creeping discharge in which high voltage impressed between the center and ground electrodes results in spark discharge of increased energy. This causes erosion of the ground electrode upon extended use.

This situation arises in recent years because the igniter is continuously used or active to successively spark during flight for the fear of cessaton of combustion, in oppositon to the counterpart which is ignited only at the time of starting.

The ground electrode is continuously exposed to high energy spark during flight so that the wear of the electrode increases relatively quickly to shorten the service life due to erosion, even when the electrode is made of nickel-based alloy such as Inconel.

To improve this situation, an iridium insert ring is placed on the annular shoulder of the ground electrode as taught in U.S. Pat. No. 3691419 wherein the insert ring is welded to the shoulder only at the outer peripheral portion by means of electron beam welding to permit only a limited recrystalization.

It, however, is dificult for the igniter to provide good heat conduction between the insert ring and the shoulder due to the limited welding area therebetween.

Beam welding leads to a series of complicated operations, and it becomes impossible to weld when the insert ring is reduced to about 0.5 mm thickness.

Furthermore, a tubular insulator is required to abut against both the top end of the shoulder and the upper flat surface of the insert ring simultaneously at the time of assembly. This necessitates the use of an insert ring of dimensional accuracy, thereby increasing manufacturing cost.

Therefore, it is an object of this invention to provide an igniter plug which is capable of assuring good heat conduction between an insert ring and the stepped seat of a ground electrode so as to prevent undue wear due to erosion, and which is conducive to the long service life.

It is another object of the invention to provide an igniter plug which is suitable for mass production owing to the fact that electrical resistant welding is employable.

It is still another object of the invention to provide an igniter plug which is capable of reducing the thickness of the insert ring to save the amount of precious metal employed, thereby conducive to cost-saving.

According to the invention, an igniter plug comprising; a shell metal having a stepped seat at the inner side adjacent to the open end to form an annular ground electrode; a tubular insulator concentrically provided at the inner side of said shell metal to rest on said stepped seat through a oxidation and heat resistant insert ring; a center electrode disposed into said insulator to have one end distanced from said insert so as to form a surface discharge gap therebetween; and said insert ring being of platinium-based alloy, and welded to said stepped seat by means of electrical resistant welding so as to form a weld layer, at least extending between said ring and said stepped seat.

DESCRIPTION OF THE PREFERRED EMBODIMENT

Figure 1:
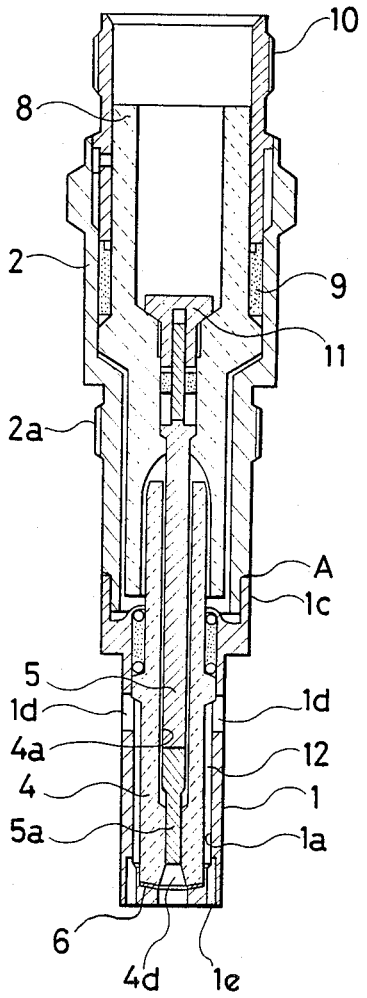
FIG. 1 is a longitudinal cross sectional view of an igniter plug according to this invention.
Figure 2:
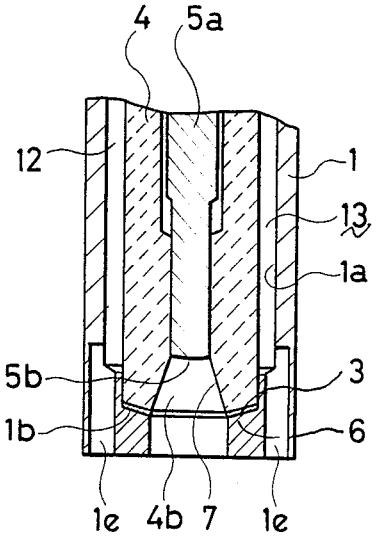
FIG. 2 is an enlarged cross sectional view of the main components of the igniter plug.
Figure 3:
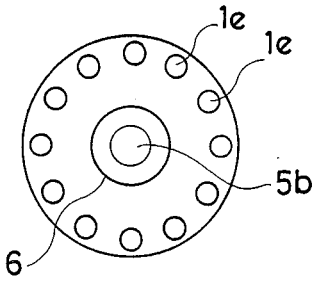
FIG. 3 is a bottom view of the igniter plug.

Herein is described with reference to the drawings of FIGS. 1 through 3 a preferred embodiment of the invention.

The igniter plug has tublar upper and lower metal shells 2, 1, each open end of which is joined by means of welding, as designated at A of the reference numeral 1*c*. Both metal shell 2, 1 are made of alloy such as Inconel, Hastelloy or stainless steel. The lower metal shell 1 has a stepped seat 1*b* adjacent at the lower open end to form an annular shoulder so as to act as a ground electrode 6, the upper surface of which is tapered to slant toward to the central axis. Upon the annular shoulder 1*b*, an insert ring 3 is embedded and which is made of a alloy of platinium-iridium (10%–30%) or alloy of platinium-iridium (10%–30%)-nickel (2%–10%), and reduced to 0.4 mm thickness. The insert ring 3 has the overall lower flat surface welded to shoulder 1*b* by electrical resistance welding. A tubular insulator 4 is substantially disposed into the lower metal shell 1 to form a doughnut-shaped space 12 therebetween. In this arrangement, insulator 4 has its lower open end on shoulder 1*b* through the insert ring 3, and at the same time, positioning center electrode 5 into axial bore 4*a*. Center electrode 5, which is made from nickel-based alloy, such as Inconel or the like, has a tungusten electrode 5*a* at the lower end to serve as its bottom in place thereof at firing end 5*b*. Firing end 5*b* is separated from the upper surface of insert ring 3 to define a surface creeping discharge gap 7 along the conical surface provided at the lower end 4*b* of the insulator 4.

At the bottom of the lower metal shell 1, longitudinal slots 1*e* are provided to communicate with doughnut-shaped space 12 and perforations 1*d* formed at the outer side of the lower metal shell 1 define a ventilation path 13 to cool the electrodes.

Into the upper portion of insulator 4, a tubular insulator 8 of increasing diameter is telescoped in concentrical relationship with the upper metal shell 2. Between the insulator 8 and upper metal shell 2, cylindrical mount metal 10 is positioned by a sealant of compacted talc powder 9. Numeral 2*a* designates a thread to mount a gas turbine engine, and terminal 11 connects the center electrode to a power source.

Figure 4:
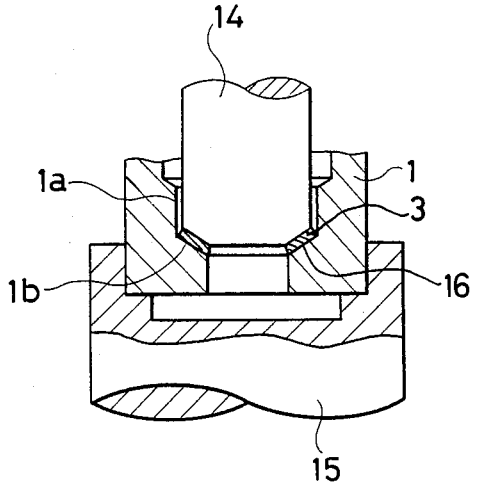
FIG. 4 is a vertical cross sectional view of how an insert ring is welded to the stepped seat of a ground electrode.
Figure 5:
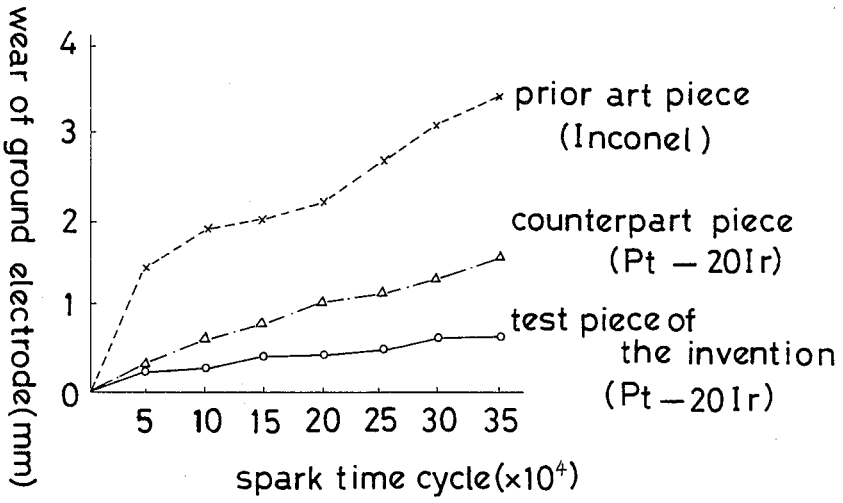
FIG. 5 is a graph showing relationship between the amount of wear and cycle time of spark.

Now, at the time of mounting the insert ring 3 to the shoulder 1*b*, the insert ring 3 is placed on the shoulder seat 1*b*, and weld electrode 14 is placed on the flat surface of the insert ring 3, while setting another weld electrode 15 under the lower end of the lower metal shell 1 as shown in FIG. 4. Then high of current is applied between the electrodes 14, 15 to weld the insert ring 3 to the shoulder seat 1*b* through a weld layer 16. In this situation, the insert ring may be welded to the lower shell metal through the outer peripheral side and the inner wall of the lower metal shell so as to further strengthen the bond therebetween.

A wear test is a conducted with a spark testing machine which sparks 12 times per minute with the output voltage as 2.6 Kv, 4 Joule. The igniter plug is under an air pressure of 100 psi and at an ambient temperature of 650 degree Centigrade in a pressure chamber. The test piece is an insert ring of 0.5 mm in thickness, and platinium-iridium alloy (20).

The counterpart or comparison test piece is taken as an insert ring similar to that of U.S. Pat. No. 3691419 to determine and compare the rate of wear. The prior art piece is a shoulder seat of the lower shell metal with no insert metal (Inconel 600). The wear rate is measured by the increase of inner diameter of the insert ring or annular shoulder seat.

The results are shown in FIG. 4 wherein graphs are shown with the longitudinal axis as spark time cycle and the latitudinal axis as the amount of wear. FIG. 4 shows that the test piece of this invention is improved a significant degree compared to the counterpart piece and prior art piece, extending to wide range of up to 350000 cycle time.

It is noted that the shoulder seat may be an untapered horizontal surface and that the igniter functions without the ventilation path 13 having a doughnut-space 12, and perforations 1*e* and slots 1*d*.

As would be understood from the above description, the insert ring is welded to the shoulder seat, thereby extending to overall resting area thereof, thus assuring good heat conduction so as to reduce the wear of the ground electrode.

With the use of electrical resistant welding, the welding operation is simplified and contributes to the furtherance of mass production.

With the use of reduced thickness insert ring, a smaller amount of precious metal is employed, thus contributing to a further cost-saving.

Further, it would be appreciated that an igniter without the ventilation path is particulaly useful for diesel engine operation. The present invention is further described in the claims which follow.

What is claimed is:

1. An igniter plug comprising:

a tubular metallic shell having a diameter-reduced seat at one open end, the seat being tapered to progressively decrease its diameter as approaching an outside of said open end;

a tubular insulator concentrically placed at an inner side of said metallic shell, and having a tapered end face to be in registration with said seat;

a frusto-cone shaped insert ring made of oxidation and heat resistant material, a peripheral end and one entire surface of which are mounted on an upper surface of said seat by means of an electrical resistant welding, said insert ring permitting said tapered end face of said insulator to engage with an upper surface of said insert ring;

a center electrode concentrically disposed in said insulator, one end of said electrode being terminated short of said tapered end face of said insulator to allow a creeping discharge to occur along an inner surface of said insulator when a high voltage is applied across said center electrode and said insert ring.

2. An igniter plug as recited in claim 1 in which said insert ring is made of platinum-iridium based alloy or platinum-iridium-nickel based alloy.

* * * * *